US006389723B1

(12) United States Patent
Rink, Jr.

(10) Patent No.: US 6,389,723 B1
(45) Date of Patent: May 21, 2002

(54) STAND FOR DISPOSABLE RAIN PROTECTION DEVICES

(76) Inventor: Joseph Bernard Rink, Jr., 4609 Beau Lac La., Metairie, LA (US) 70002

( * ) Notice: Subject to any disclaimer, the term of this patent is extended or adjusted under 35 U.S.C. 154(b) by 0 days.

(21) Appl. No.: 09/495,086

(22) Filed: Jan. 31, 2000

(51) Int. Cl.[7] ..... G09F 23/06

(52) U.S. Cl. ..... 40/642.02; 248/304; 223/85; 40/322; 40/642.01

(58) Field of Search ..... 40/322, 642.01, 40/642.02; 248/304, 339, 307; 206/292, 296, 495, 278, 477; 223/85

(56) References Cited

U.S. PATENT DOCUMENTS 191,645 A * 6/1877 Breese ..... 248/304
3,252,236 A * 5/1966 Davis ..... 40/791
3,285,406 A * 11/1966 Winesett ..... 206/554
3,978,601 A * 9/1976 Catron ..... 40/322
4,502,599 A * 3/1985 Perecman ..... 206/554
5,683,003 A * 11/1997 Gebka

* cited by examiner

*Primary Examiner*—Cassandra H. Davis
(74) *Attorney, Agent, or Firm*—Adams and Reese, LLP

(57) ABSTRACT

An apparatus for displaying and dispensing disposable rain protection devices comprising a sign holder and a bracket member on the sign holder, the bracket member configured to hold disposable rain protection devices when the bracket member is mounted on a wall. The bracket member comprises a pair of hooks. A support portion of each hook extends from the sign holder. A suspension portion of each hook is positioned to extend outward from the wall and the sign holder when the device is mounted on the wall to thereby permit the suspension portion to hold the disposable rain protection devices for display and dispensing. The bracket member further comprises an elongated bar, the elongated bar fixedly positioned substantially along a lower edge of the sign holder, and an upper end the support portions of the hooks fixedly positioned on either end of the elongated bar.

15 Claims, 3 Drawing Sheets

STAND FOR DISPOSABLE RAIN PROTECTION DEVICES

FIELD OF INVENTION

The present invention relates to stands for displaying and dispensing disposable rain protection devices, such as rain hoods and bags for storing wet umbrellas, and more particularly to a wall mounted stand for displaying and dispensing such items.

BACKGROUND OF THE INVENTION

The inventor has previously invented disposable receptacles for umbrellas, along with devices for the display and dispensing of such receptacles. The inventor has further developed a market for such devices. The present invention relates to a novel apparatus and methods for displaying disposable receptacles for umbrellas and other disposable rain protection devices, and is directed generally to overcoming the following problems associated with the prior art.

New umbrellas are generally sold with a storage bag. The storage bag is usually made of a material similar to the collapsible cover of the umbrella, such as a nylon weave, and is sized and configured to hold the umbrella when the umbrella has been collapsed and is not in use. If the umbrella is wet from a recent rain shower, placing the umbrella in the storage bag will keep the rain water from dripping off of the umbrella and wetting the floor, where the water may dirty the floor or cause a passerby to slip. However, because the owner of an umbrella seldom knows when he or she will need to use the umbrella, the owner will frequently, and often haphazardly, place the umbrella in a place where it will be available at a moment's notice, such as in an office desk, a purse, a brief case, the floor of a closet, the trunk of an automobile, or even the floor of an automobile. After a period of storage and use of the umbrella, the storage bag often becomes lost, and in any event is usually unavailable when needed following use of the umbrella during a rain shower.

In order to address the foregoing problems, the inventor previously developed an apparatus and method for supplying disposable receptacles for umbrellas. The disposable receptacles consist of an elongated plastic bag that is designed to fit over a collapsed umbrella. The disposable receptacles keep wet umbrellas from dripping water, and thus prevent slips, soiling of floors and carpets, and other consequences of tracking rain water into a public building.

The inventor has also developed a stand for displaying and dispensing disposable receptacles for umbrellas. Such display stands originally consisted generally of a base for supporting the stand, a pole extending substantially vertically upward from the base, and a pair of display prongs positioned adjacent an upper end of the pole. In using such stands, it was discovered that because the display stands were generally placed in areas of heavy foot traffic, the stands provided a potential medium for advertising. In order to utilize this advertising potential, the display stand is preferably provided with a sign holder on the upper end of the pole. The sign holder preferably consists of a pair of parallel plates having an inwardly turned lower edge and inwardly turned side edges, the inwardly turned edges providing a means for holding a sign insert. A patent is presently pending on embodiments of the display stand and receptacle for umbrellas. Such stands are distributed by Custom Specialties & Supply, Inc. of Metairie, La.

The above display stands and disposable receptacles for umbrellas have been successful on the market, particularly in public buildings that have heavy foot traffic. However, the disposable receptacles are useful only for individuals who happen to have umbrellas with them; they do not help individuals who do not happen to have rain protection garments with them during the outbreak of a rain shower. Rain protection garments, such as rain coats, rain hoods, ponchos, and the like, are used to keep individuals dry during rain showers. Such garments are typically designed for repeated use, and are therefore made of durable, rain impermeable materials such as canvas, oilcloth, nylon and the like. Disposable rain hoods and ponchos are also available. Disposable rain hoods are typically made of plastic sheets. Disposable rain hoods find particular uses at outdoor events, such as festivals and sporting events, where a sudden, unexpected shower may catch individuals without umbrellas or rain protection garments. In such circumstances, disposable rain hoods can be sold at low cost or donated to individuals attending the event, and can then be discarded when no longer needed. However, in many cases, a source of disposable rain hoods is not available during a sudden rain shower. In particular, a source of disposable rain hoods is nearly always unavailable for occupants of most public buildings, such as stores, office buildings, government buildings, churches, and the like. There is thus a need for a disposable rain hood and an apparatus for displaying such hoods for dispensing as needed during rain showers. The inventor has recently filed a patent application on such a hood, which is described in further detail below.

The above design for a stand has been successful in buildings that have large amounts of floor space. However, in small areas, such as a small office, store, or reception area, the above stand design may take up more space than is readily available, or may give rise to a crowded appearance. There is thus a need for a stand for displaying and dispensing disposable rain protection devices, such as receptacles for holding umbrellas and rain hoods, that can be mounted on a wall or other existing structure.

OBJECTS AND SUMMARY OF THE INVENTION

It is an object of the invention to provide an improved means for displaying and dispensing disposable rain protection devices, such as receptacles for umbrellas and rain hoods.

It is another object of the invention to provide an apparatus for displaying and dispensing disposable rain protection devices in areas of limited space.

It is another object of the invention to provide a wall mounted apparatus for displaying and dispensing disposable rain protection devices that is easy to mount on a wall or other existing structure.

It is another object of the invention to provide novel methods of displaying the disposable rain protection devices for distribution as needed during rain showers.

These and other objects and advantages of the invention shall become apparent from the following general and preferred description of the invention.

Accordingly, an apparatus for displaying and dispensing disposable rain protection devices is provided comprising a bracket member and a means for mounting the apparatus on a wall, the bracket member configured to hold the disposable rain protection devices when the bracket member is mounted on the wall. The apparatus is preferably provided with a sign holder. The sign holder preferably comprises a plate and a plurality of frame members. The frame members are positioned substantially along opposing side edges and a lower edge of the plate, and the frame members are configured to retain a sign in the sign holder. A sign can be removably mounted in the sign holder. The bracket member preferably comprises at least one hook. A support portion of the hook extends from the sign holder, while a suspension portion of the hook is positioned to extend outward from the wall and the sign holder when the device is mounted on the wall to thereby permit the suspension portion to hold disposable rain protection devices for display and dispensing. In a preferred embodiment, the bracket member has two hooks, and the bracket member further comprises an elongated bar. The elongated bar is fixedly positioned substantially along a lower edge of the sign holder, and an upper end of the support portion of each hook is fixedly positioned on either end of the elongated bar. In a preferred embodiment, each hook is further braced relative to the sign holder by a brace member. The brace member extends downward from the sign holder along the support portion of the hook, and the support portion of the hook is fixedly connected to the brace member.

The apparatus is provided with a plurality of disposable rain protection devices, such as disposable receptacles for umbrellas or disposable rain hoods. Designs for rain hoods are provided, the designs being particularly suited for display and dispensing from a stand such as the apparatus of the invention. The plurality of rain protection devices may be individually suspended from the bracket member. In a preferred embodiment, a plurality of disposable rain protection devices are stacked together. The stack of disposable rain protection devices is secured to a receptacle display holder, the display holder having a means thereon for allowing the stack of disposable receptacles to be suspended from the bracket member for display and dispensing. Each of the disposable rain protection devices is preferably detachable from the stack by a frangible perforated connection.

Methods of using the foregoing apparatus for displaying and dispensing disposable rain protection devices are also provided.

PREFERRED EMBODIMENTS OF THE INVENTION

Figure 1:
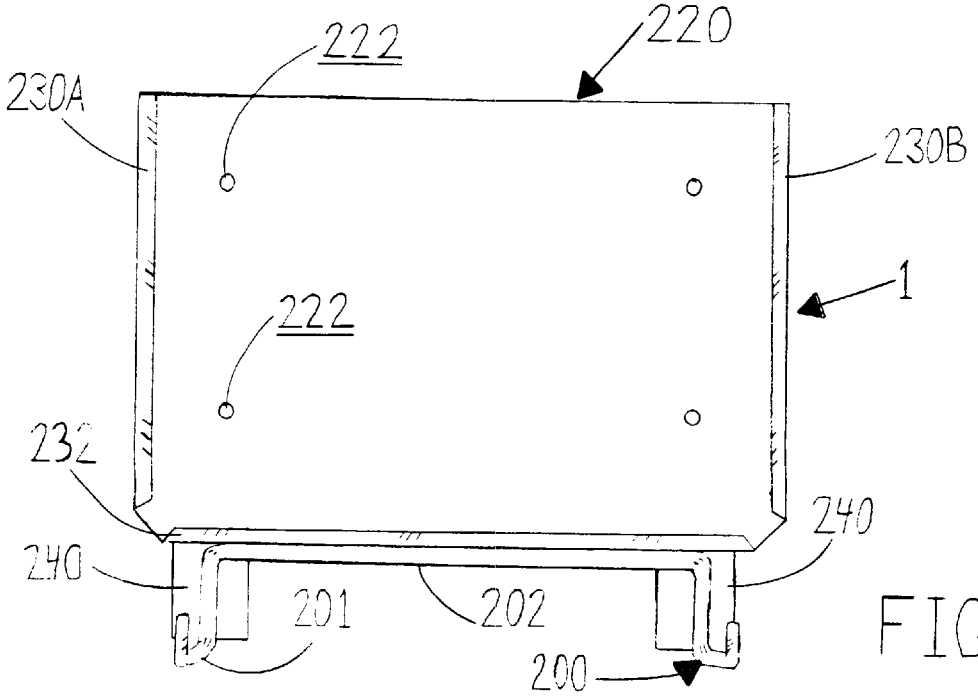
FIG. 1 is a front view of one preferred embodiment of the invention.

As shown in FIG. 1, the apparatus for displaying and dispensing disposable rain protection devices of the invention 1 comprises, generally, a bracket member 200 and a means, e.g. 220, 222 for mounting the bracket member on a wall. The bracket member 200 is configured to hold disposable rain protection devices 3,106 (see FIGS. 2–4) when the bracket member 200 is mounted on a wall 300. The basic concept of the invention is to provide a stand for displaying and dispensing disposable rain protection devices that can be mounted on existing structures in a building or the like, thereby eliminating the need to provide a structure, such as a base and vertical pole, for displaying such items. As such, the term "wall" as used herein means conventional walls of buildings, including both inside and outside walls. Additionally, the term "wall" as used herein also includes other generally fixed structures of buildings, such as vertical or horizontal beams, walls of counters, shelves, doors, and the like.

As shown in FIGS. 1–4, the apparatus is preferably provided with a sign holder 220. In a preferred embodiment, the sign holder 220 comprises a plate and a plurality of frame members 230A, 230B, 232. The frame members 230A, 230B, 232 are positioned substantially along opposing side edges and a lower edge of the plate, and are configured to retain a sign in the sign holder 220. In the preferred embodiment shown in FIGS. 1–4, the sign holder 220 consists of a substantially rectangular plate 220. Three side edges 230A, 230B, 232 of the plate 220 are turned inward toward a front surface of the plate. The inwardly turned sides 230A, 230B, 232 define grooves for receiving and retaining a sign in the sign holder 220. A sign 400 can be removably mounted in the sign holder 220 by sliding the sign 400 into the grooves 230A, 230B, 232. The sign 400 may provide writing, logos, or other indicia 410 related to advertising or providing information, including advertising or information about the disposable rain protection devices 3, 106 on the stand 1.

Figure 3:
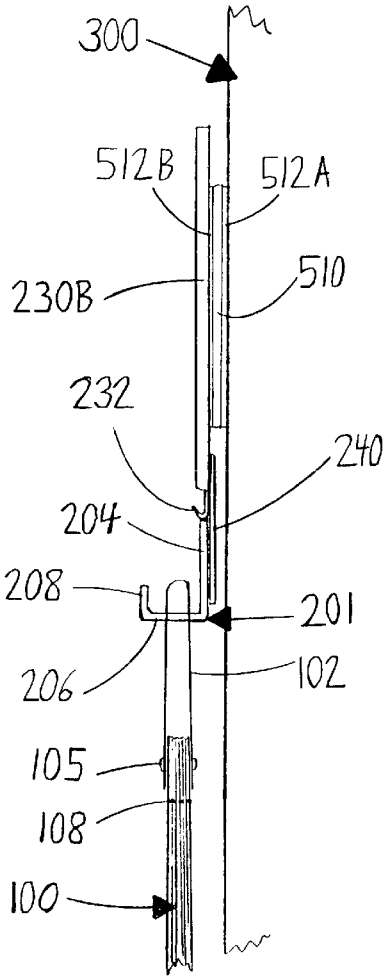
FIG. 3 is a side-view of the display stand of FIG. 2, illustrating the stand mounted on a wall by adhesive means, such as double sided tape.

As shown most clearly in FIG. 3, the bracket member 200 preferably comprises at least one hook 201. In the embodiment shown in FIG. 3, a support portion 204 of the hook 201 extends from the sign holder 220. The support portion 204 preferably extends downward or sideward from the sign holder 220, such that items suspended from the hook 201 will not obscure the surface of the sign holder 220 or sign 400. A suspension portion 206 of the hook 201 is positioned to extend outward from the wall 300 and the sign holder 220 when the device is mounted on the wall 300, to thereby permit the suspension portion 206 to hold the disposable rain protection devices 3, 106 for display and dispensing. In the preferred embodiment shown most clearly in FIG. 3, the hook 201 is configured as a substantially vertical downwardly depending support portion 204, a suspension portion 206 extending substantially perpendicularly from a lower end of the support portion 204, and the suspension portion 206 having an upwardly turned prong 208 for securing disposable rain protection devices 3, 106 on the hook 201.

In the preferred embodiment shown in FIGS. 1–4, the bracket member 200 has two of the hooks 201. The bracket member also preferably further comprises an elongated bar 202. The elongated bar 202 is preferably fixedly positioned substantially along a lower edge 232 of the sign holder 220. An upper end of the support portion 204 of each hook 201 is preferably fixedly positioned on either end of the elongated bar 202. This particular embodiment can be formed from a single piece of heavy steel wire (e.g. 0.5 cm diameter wire).

Figure 2:
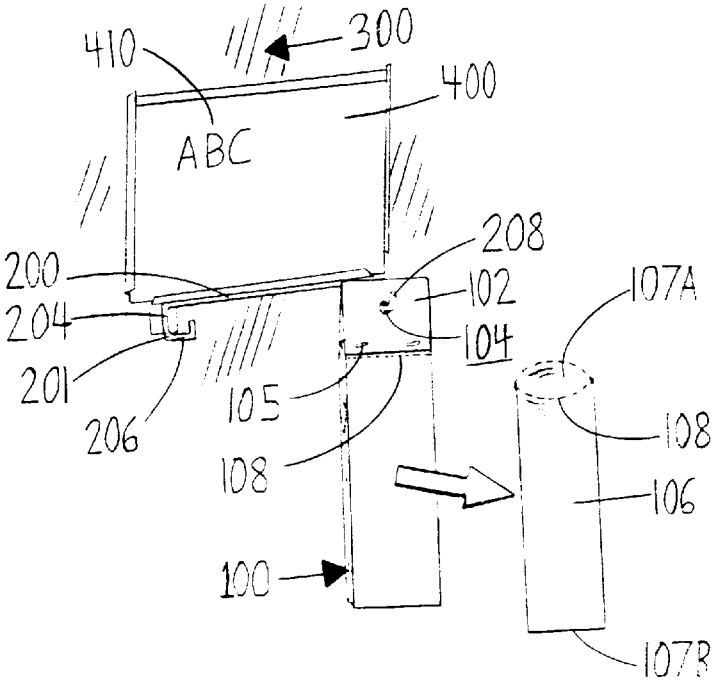
FIG. 2 is a frontal perspective view of one preferred embodiment of the invention, showing the stand mounted on a wall, and showing a plurality of receptacles for umbrellas suspended from the stand.

In a preferred embodiment shown most clearly in FIGS. 2–3, each hook 201 is preferably further braced relative to the sign holder 220 by a brace member 240. In a preferred embodiment, the brace member 240 extends downward from the sign holder 220 along the support portion 204 of the hook 201, and the support portion 204 of the hook 201 is fixedly connected to the brace member 240, such as by welding. The brace member 240 may be a small sheet of metal welded to the back of the sign holder, as shown most clearly in FIG. 3.

Figure 4:
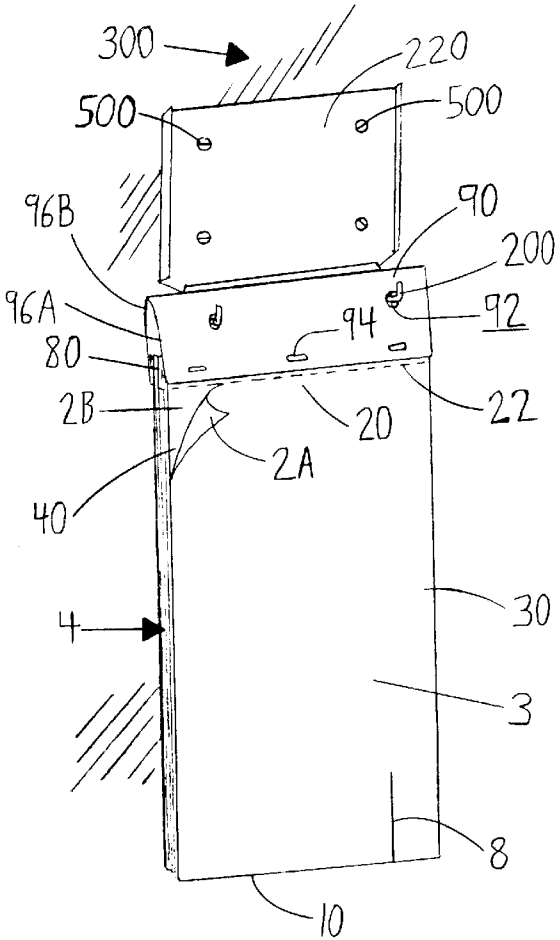
FIG. 4 is a frontal perspective view of one preferred embodiment of the invention, showing the stand mounted on a wall, and showing a plurality of disposable rain hoods suspended from the stand.

Various means can be used for mounting the apparatus of the invention 1 on a wall 300. FIG. 1 shows a plurality of holes 222 through the sign holder 220. FIG. 4 shows a screw, bolt, nail, or the like 500 inserted through a hole 222 and into the wall 300 to thereby secure the apparatus 1 on the wall 300. FIG. 3 shows the use of adhesive tape 510, the tape 510 preferably having adhesive 512A, 512B on either side, as a mounting means. Alternatively, hooks could be provided on the wall 300 for latching onto hooks, eyelets, or a picture wire positioned on the back of the sign holder 220, in the conventional manner of hanging pictures or other wall mounted items.

The various components of the invention 1 can be constructed of conventional rigid and generally durable materials, such as metal, plastic, or wood. Steel provides a durable bracket and sign holder that can be economically manufactured using conventional bending, shaping, and welding techniques.

As shown in FIGS. 2–4, the apparatus of the invention 1 is used to display and dispense disposable rain protection devices 3, 106 by hanging or suspending such devices 3, 106 from the bracket member 200. FIGS. 2–3 show a set or stack arrangement 100 of disposable receptacles for umbrellas 106 suspended from the bracket member 200. FIG. 4 shows a set or stack arrangement 4 of disposable rain hoods 3 suspended from the bracket member 200. Details of each of these disposable rain protection devices 3, 106 will now be described.

FIGS. 2–3 show disposable receptacles for umbrellas 106, the receptacles being stacked together in a set 100. The disposable receptacles 106 are similar to plastic bags, but are elongated so as to fit a collapsed umbrella. The disposable receptacles 106 have an open end 107A for receiving an umbrella and a closed end 107B for preventing water from a wet umbrella from leaking from the receptacle 106. A set of large sized receptacles can be provided for large umbrellas, and a set of small sized receptacles can be provided for small umbrellas. Each disposable receptacle 106 can be provided with a means thereon, such as a hole, for allowing the disposable receptacle 106 to be suspended from the bracket member 200. A plurality of disposable receptacles 106 are preferably stacked together, as shown in FIGS. 2–3. The plurality of disposable receptacles 106 preferably extend from a receptacle display holder 102. In a preferred embodiment, the receptacle display holder 102 is a piece of light weight cardboard that is folded over one end of a plurality of disposable receptacles 106 and secured in place by staples. The display holder 102 has a means thereon, such as an aperture 104, eyelets, velcro or other like attachment mechanism, to allow the set of receptacles 100 to be suspended from the bracket member 200, as shown in FIGS. 2 and 3. In a preferred embodiment, each of the receptacles for umbrellas 106 is detachable from the set of receptacles 100 by a frangible perforated connection 108.

Figure 5:
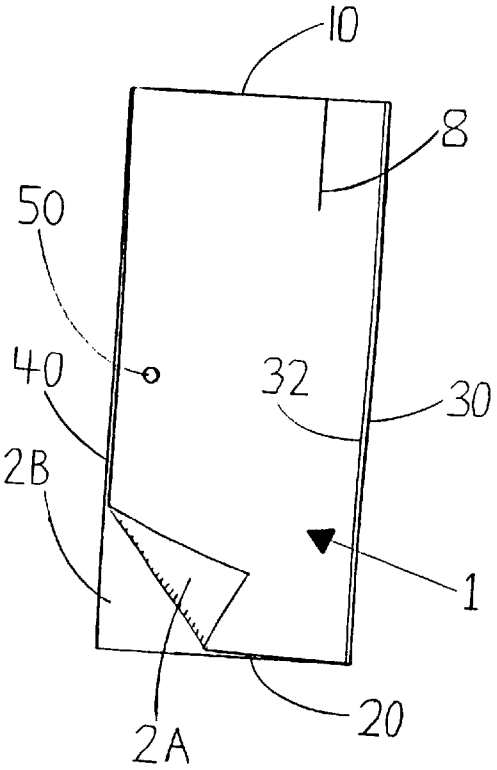
FIG. 5 is a side view of one preferred embodiment of the disposable rain hood of the invention.

FIG. 5 shows a side view of a preferred embodiment of a disposable rain hood 3, the disposable rain hood being particularly designed for dispensing from a display stand such as the apparatus of the invention 1. The rain hood comprises, generally, a pair of opposing flaps 2A, 2B, the flaps being composed of conventional plastic sheeting or other inexpensive rain impermeable material. In FIGS. 4 and 5, flap 2A is shown partially folded back at a front-lower comer. The flaps 2A, 2B are attached to one another substantially along respective upper edges 10 thereof. The flaps 2A, 2B are further attached to one another substantially along respective rear edges 30 thereof. The upper 10 and rear 30 edge attachments provide a rain-impermeable barrier along the upper 10 and the rear 30 edges of the disposable rain hood. With the flaps 2A, 2B sealed together in the foregoing manner, the disposable rain hood 3 has a substantially open front edge 40 and a substantially open lower edge 20. The open front 40 and lower edges 20 permit the disposable rain hood 3 to receive a head and torso of a user 99, as shown most clearly in FIG. 6.

The pair of flaps 2A, 2B are preferably formed from a single lengthwise sheet of plastic. In the preferred embodiment shown in FIG. 5, the sheet is folded substantially along a width-wise centerline 10 thereof to thereby form the pair of lengthwise opposing flaps 2A, 2B. The sheet is preferably about 37 by 30 inches (94 by 76 cm) prior to folding, which forms an approximately 37 by 15 inch (94 by 38 cm) hood after folding. The fold 10 forms the upper edge 10 of the disposable rain hood 3, and the rear edge attachment 30 is preferably formed by heat sealing the rear edges 30 of the flaps to one another. Such heat sealing methods are well known to those of ordinary skill in the art, but as far as is known such heat sealing methods have not been applied to disposable rain hoods as described herein. FIG. 5 shows an example of a heat seal 32 sealing rear edge 30. In another embodiment, the sheet is folded substantially along a lengthwise centerline 30 thereof to thereby form the pair of lengthwise opposing flaps 2A, 2B. In this embodiment, the fold 30 forms the rear edge 30 of the disposable rain hood, and the upper edge attachment 10 is formed by heat sealing the upper edges 10 of the flaps 2A, 2B to one another. Alternatively, the disposable rain hood 3 can be formed from a pair of lengthwise sheets 2A, 2B, the two sheets being sealed together, preferably by heat sealing, to form the upper 10 and rear 30 edge attachments.

Figure 6:
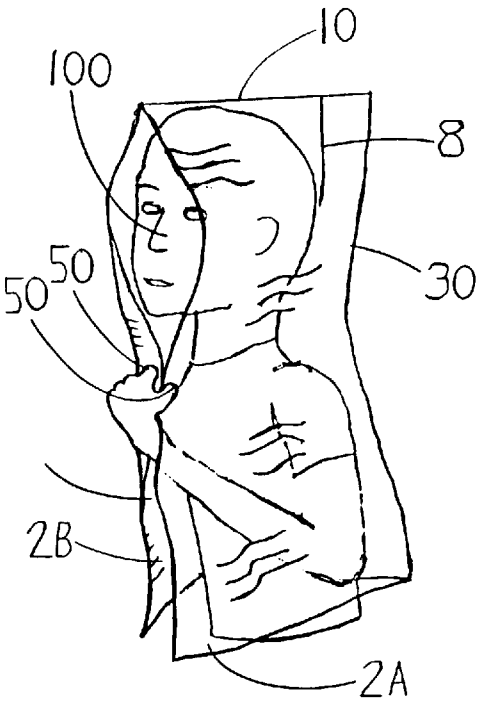
FIG. 6 is a perspective front-side view of one preferred embodiment of the disposable rain hood of the invention as shown in FIG. 5 illustrating the disposable rain hood covering the head and torso of a user.

As shown most clearly in FIG. 6, the apparatus of the invention 1 is preferably further provided with a head stop 8. The head stop 8 serves to properly position the head of a user 99 in the disposable rain hood 3. The head stop 8 further attaches the respective flaps 2A, 2B to one another. The head stop 8 extends downward substantially from the sealed upper edge 10 of the disposable hood and extends substantially parallel to an upper portion of the sealed rear edge 30. The head stop 8 is positioned a sufficient distance from the open front edge 40 of the disposable rain hood 3 to thereby permit the head stop 8 to function as a rear barrier for a back portion of the head of the user 99 while the rain hood simultaneously shields the head of the user 99 from rain. The head stop 8 is preferably formed by heat sealing the flaps 2A, 2B to one another along the desired position of the head stop 8. Alternatively, stapling, stitching, or the like could be used to form the head stop 8.

The disposable rain hood 3 is also preferably provided with at least one hole 50 positioned substantially along the forward edge 40 of each of the flaps 2A, 2B. The holes 50 are positioned to permit the forward edges 40 of the disposable rain hood to be selectively held together either by fingers of the user 99 or by a tie (e.g. string or a twist-tie) passing through the holes (the tie taking the place of fingers) to thereby secure the hood on the user, as shown in FIG. 6. This feature is designed particularly for windy conditions, where a light-weight disposable rain hood 3 could be blown off of a user 99 by a gust of wind. Although only one pair of holes 50 is shown in the drawings, additional holes 50 can be provided along the open edge 40 to thereby accommodate different sizes and preferences of users 100.

FIG. 4 shows a stack arrangement 4 of a plurality of disposable rain hoods 3. In this embodiment, each of the hoods 3 has a suspension portion 80 extending from the lower edges 20 of the flaps 2A, 2B. The suspension portion 80 is detachably connected to the lower edge 20 of the flaps 2A, 2B by a frangible perforation 22. The stack 4 is preferably provided with a display holder 90. The display holder 90 has a means thereon for suspending the display holder from the display stand, such as a pair of holes 92, or eyelets, velcro or other like attachment mechanism. In the preferred embodiment shown in FIG. 4, the display holder 90 is a piece of cardboard 90 or like material. The piece of cardboard 90 is folded over a plurality of the suspension portions 80. Opposing flaps 96A, 96B of the display holder 220 are attached to one another by a plurality of staples 94 passing through the plurality of suspension portions 80. The stack 4 of disposable hoods 3 is fixedly attached to the display holder 90 via the suspension portions 80 such that a selected disposable rain hood 3 may be selectively detached from the suspension portion 80 by pulling the disposable hood 3 relative to the holder 90 to thereby break the frangible perforation 22. In a preferred embodiment, the stack is originally provided with about 30–35 hoods, which provides a sufficient number of hoods for most applications, such as supplying heavy demand during a sudden rain shower, while avoiding an unduly bulky stack of disposable rain hoods 3 on the display stand 200.

The foregoing stacked arrangement 4 provides a convenient means of handling multiple disposable rain hoods 3, such as during shipping and transport, and of displaying a plurality of disposable rain hoods 3 from a display stand 200. However, in an alternative embodiment, individual disposable rain hoods 3 can be provided with a pair of holes 92 adjacent and passing through said lower end 20 of said disposable rain hood 3, the holes 92 providing a means for displaying the disposable rain hood 3 from the display stand 200.

In operation, the apparatus of the invention 1 may be stored until needed, such as during a sudden rain shower. Alternatively, the stand 1 may be mounted on a wall 300 for permanent display and dispensing of disposable rain protection devices 3, 106. With the apparatus of the invention 1 securely mounted on a wall 300, a plurality of disposable rain protection devices 3, 106 are suspended from the bracket member 200 such that individual disposable rain protection devices 3, 106 may be selectively removed from the bracket member 200, such as by a frangible perforation 22, 108, thereby supplying passers-by with a ready source of disposable rain protection devices. The suspended disposable rain protection devices may be either disposable receptacles for umbrellas 106, disposable rain hoods 3, or such other disposable rain protection devices as may from time to time be developed. The desired disposable rain protection device may vary according to weather conditions. At the beginning of a rain shower, it may be preferable to display disposable rain hoods 3 for individuals who are leaving the building. Near the end of the rain shower, or when individuals start entering the building with wet umbrellas, it may be desirable to replace the disposable rain hoods 3 with disposable receptacles for umbrellas 106. Additionally, both disposable receptacles for umbrellas 106 and disposable rain hoods 3 may be displayed at the same time. The disposable rain protection devices 3, 106 may be suspended individually or as part of a stacked set 4, 100. If a sign holder 220 is provided on the apparatus 1, a sign 400 can be inserted in the sign holder 220 to thereby provide information or advertising 410 to passers-by.

The disposable rain hoods 1 can be constructed according to the following methods. A sheet of plastic 1 is cut or provided in a lengthwise format, i.e. a generally rectangular shape (e.g. 30 by 37 inches). The sheet is folded substantially along a centerline (see e.g. 10 or 30) to thereby form the pair of flaps 2A, 2B. The flaps 2A, 2B are then heat sealed together substantially along an edge adjacent to the fold (see e.g 10 or 30). The folding and heat sealing thereby form a sealed upper edge 10 and a sealed rear edge 30, and also thereby leave an open front edge 40 and an open lower edge 20 of the disposable rain hood 3 for receiving a head and torso of a user 99 of the disposable rain hood 3. A head stop 8 can be formed by heat sealing the flaps 2A, 2B together along a line 8 extending downward substantially from the sealed upper edge 10 of the disposable hood 1 and extending substantially parallel to an upper portion of the sealed rear edge 30, the head stop 8 being positioned a sufficient distance from the open front edge 40 of the disposable rain hood to thereby permit the head stop 8 to function as a rear barrier for a back portion of the head of the user 99 while the hood simultaneously shields the head of the user 99 from rain. At least one hole 50 can be punched in each of the flaps 2A, 2B, preferably substantially along the forward edge 40, the holes 50 being positioned to permit the forward edges 40 of the disposable rain hood 3 to be selectively held together either by fingers of the user 99 or by a tie passing through the holes 50 to thereby secure the hood 1 on the user 99, as shown most clearly in FIG. 6. The suspension portion 80 can be formed below the lower edge 20 by punching a frangible perforation 22 substantially along and adjacent the lower edge 20 of the flaps 2A, 2B, thereby leaving a desired length for the suspension portion 80.

Preparation of a stack 4 of disposable rain hoods is accomplished by first constructing a plurality of the disposable rain hoods 1. The plurality of disposable rain hoods 1 are then stacked together such that the suspension portions 80 are stacked atop one another and such that the upper edges 10 are stacked atop one another, as shown in FIGS. 3 and 4. A display holder 90 is then stapled or otherwise attached to the suspension portions 80, such that the plurality of disposable rain hoods 1 are held together at the suspension portions 80, such that the stack 4 may be suspended from a display stand 200 by a suspension means 92 on the display holder 90, and such that a selected disposable rain hood 3 may be selectively detached from the suspension portion 80 by pulling the 20 selected disposable hood 1 relative to the display holder 90 to thereby break the frangible perforation 22.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. An apparatus for displaying and dispensing disposable rain protection devices comprising:

a sign holder, a bracket member on said sign holder, and a means for mounting said apparatus on a wall, said bracket member configured to hold disposable rain protection devices when said bracket member is mounted on said wall, said bracket member comprising a pair of hooks, a support portion of each said hook extending from said sign holder, a suspension portion of each said hook positioned to extend outward from said wall and said sign holder when said device is mounted on said wall to thereby permit said suspension portion to hold said disposable rain protection devices for display and dispensing, and said bracket member further comprising an elongated bar, said elongated bar fixedly positioned substantially along a lower edge of said sign holder, an upper end of said support portion of each said hook fixedly positioned on either end of said elongated bar.

2. The apparatus of claim 1, wherein said sign holder comprises a plate and a plurality of frame members, said frame members positioned substantially along opposing side edges and a lower edge of said plate, and said frame members configured to retain a sign in said sign holder.

3. The apparatus of claim 2, further comprising a sign removably mounted in said sign holder.

4. The apparatus of claim 1, wherein each said hook is further braced relative to said sign holder by a brace member, said brace member extending downward from said sign holder along said support portion of said hook, said support portion of said hook fixedly connected to said brace member.

5. The apparatus of claim 1, further comprising a plurality of disposable receptacles for umbrellas, said disposable receptacles being stacked together, said stack of disposable receptacles secured to a receptacle display holder, said display holder having a means thereon for allowing said stack of disposable receptacles to be suspended from said bracket member for display and dispensing, and said plurality of disposable receptacles for umbrellas suspended from said bracket member.

6. The apparatus of claim 5, wherein each of said disposable receptacles for umbrellas is detachable from said stack by a frangible perforated connection.

7. The apparatus of claim 1, further comprising a plurality of disposable rain hoods, each said disposable rain hood having means thereon for allowing said disposable rain hood to be suspended from said bracket member for display and dispensing, and said plurality of disposable rain hoods suspended from said bracket member.

8. The apparatus of claim 7, wherein each said disposable rain hood comprises:

a pair of opposing flaps, said flaps attached to one another substantially along respective upper edges thereof, said flaps further attached to one another substantially along respective rear edges thereof, said upper and rear edge attachments providing a rain-impermeable barrier along said upper and said rear edges of said disposable rain hood, and said disposable rain hood having a substantially open front edge and a substantially open lower edge for receiving a head and torso of a user of said disposable rain hood.

9. The apparatus of claim 8, further comprising each said disposable rain hood having a head stop further attaching said respective opposing flaps to one another, said head stop extending downward substantially from said sealed upper edge of said disposable hood and extending substantially parallel to an upper portion of said sealed rear edge, said head stop being positioned a sufficient distance from said open front edge of said disposable rain hood to thereby permit said head stop to function as a rear barrier for a back portion of said head of said user while said hood simultaneously shields said head of said user from rain.

10. The apparatus of claim 8, further comprising each of said flaps having at least one hole positioned substantially along said forward edge, said holes positioned to permit said forward edges of said disposable rain hood to be selectively held together either by fingers of said user or by a tie passing through said holes to thereby secure said hood on said user.

11. The apparatus of claim 8, wherein said plurality of said disposable hoods are stacked together, and further comprising each of said disposable hoods having a suspension portion extending from said lower edges of said flaps, said suspension portion detachably connected to said lower edge of said flaps by a frangible perforation, and a display holder, said means for allowing each said disposable rain hood to be suspended from said bracket member for display and dispensing being on said display holder, said stack of disposable hoods fixedly attached to said display holder via said suspension portions such that a selected disposable rain hood may be selectively detached from said suspension portion by pulling said disposable hood relative to said display holder to thereby break said frangible perforation.

12. The apparatus of claim 1, further comprising a plurality of disposable rain hoods, said disposable rain hoods being stacked together, said stack of disposable rain hoods secured to a display holder, said display holder having a means thereon for allowing said stack of disposable rain hoods to be suspended from said bracket member for display and dispensing, and said plurality of disposable rain hoods suspended from said bracket member.

13. The apparatus of claim 12, wherein each of said disposable rain hoods is detachable from said stack by a frangible perforated connection.

14. An apparatus for displaying and dispensing disposable rain protection devices comprising:

a bracket member and a means for mounting said bracket member on a wall, said bracket member configured to hold disposable rain protection devices when said bracket member is mounted on said wall, said bracket member comprising a pair of hooks, a support portion of each said hook extending from a sign holder, a suspension portion of each said hook positioned to extend outward from said wall and said sign holder when said device is mounted on said wall to thereby permit said suspension portion to hold said disposable rain protection devices for display and dispensing, said bracket member further comprising an elongated bar, said elongated bar fixedly positioned substantially along a lower edge of said sign holder, an upper end of said support portion of each said hook fixedly positioned on either end of said elongated bar, and a plurality of disposable rain protection devices suspended from said bracket member.

15. The apparatus of claim 14, wherein each said hook is further braced relative to said sign holder by a brace member, said brace member extending downward from said sign holder along said support portion of said hook, said support portion of said hook fixedly connected to said brace member.

* * * * *